US011183148B2

(12) United States Patent
Tai et al.

(10) Patent No.: US 11,183,148 B2
(45) Date of Patent: Nov. 23, 2021

(54) IMAGE DISPLAY DEVICE AND METHOD OF OPERATING THE SAME

(71) Applicant: SAMSUNG ELECTRONICS CO., LTD., Suwon-si (KR)

(72) Inventors: Yongmin Tai, Suwon-si (KR); Dohyung Kim, Suwon-si (KR); Jinsung Kang, Suwon-si (KR); Kyuheon Lee, Suwon-si (KR); Sunghwan Jang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/662,290

(22) Filed: Oct. 24, 2019

(65) Prior Publication Data

US 2020/0143770 A1 May 7, 2020

(30) Foreign Application Priority Data

Nov. 1, 2018 (KR) ..... 10-2018-0133135

(51) Int. Cl.
*G09G 5/10* (2006.01)

(52) U.S. Cl.
CPC ..... *G09G 5/10* (2013.01); *G09G 2310/0237* (2013.01); *G09G 2320/064* (2013.01); *G09G 2360/141* (2013.01)

(58) Field of Classification Search
CPC .... G09G 10/02; G09G 3/3406; G09G 3/2003; G09G 2320/064; G09G 2320/0626; G09G 2320/0646; G09G 2320/08; G09G 2320/0233; G09G 2320/066;
(Continued)

(56) References Cited

U.S. PATENT DOCUMENTS

| | | | |
|---|---|---|---|
| 9,955,426 | B2 | 4/2018 | Herz et al. |
| 2014/0160180 | A1 | 6/2014 | Oda et al. |
| 2017/0110065 | A1 | 4/2017 | Zhang et al. |

(Continued)

FOREIGN PATENT DOCUMENTS

| | | | |
|---|---|---|---|
| EP | 3340227 | A1 | 6/2018 |
| JP | 2009-251066 | A | 10/2009 |
| KR | 10-1179785 | B1 | 9/2012 |

OTHER PUBLICATIONS

Communication dated Jan. 30, 2020, from the European Patent Office in counterpart European Application No. 19203944.4.

*Primary Examiner* — Christopher E Leiby
(74) *Attorney, Agent, or Firm* — Sughrue Mion, PLLC

(57) ABSTRACT

Provided are an image display device and a method of operating the same. The image display device includes a backlight unit configured to emit light towards a display panel. The image display device includes an illuminance sensor configured to obtain illuminance information associated with an area that is external to the image display device. The image display device includes a memory configured to store one or more instructions, and a processor configured to execute the one or more instructions stored in the memory to identify a plurality of backlight control patterns, select a backlight control pattern based on the illuminance information, identify brightness information of a current frame, and adjust the brightness of the backlight unit based on the selected backlight control pattern and the brightness information of the current frame.

16 Claims, 11 Drawing Sheets

(58) Field of Classification Search
CPC ..... G09G 2320/0666; G09G 2360/144; G09G 2360/141; G09G 2360/16
See application file for complete search history.

(56) References Cited

U.S. PATENT DOCUMENTS

| | | | | |
|---|---|---|---|---|
| 2017/0213523 | A1 | 7/2017 | Liu | |
| 2018/0350308 | A1* | 12/2018 | Zhang | G09G 3/3426 |
| 2019/0005898 | A1* | 1/2019 | Albrecht | G09G 3/3426 |

* cited by examiner

IMAGE DISPLAY DEVICE AND METHOD OF OPERATING THE SAME

CROSS-REFERENCE TO RELATED APPLICATION(S)

This application is based on and claims priority under 35 U.S.C. § 119 to Korean Patent Application No. 10-2018-0133135, filed on Nov. 1, 2018, in the Korean Intellectual Property Office, the disclosure of which is incorporated by reference herein in its entirety.

BACKGROUND

1. Field

The disclosure relates to an image display device and a method of operating the same, and more particularly, to an image display device configured to adjust the brightness of a backlight unit based on illuminance information of an area around the image display device and a method of operating the same.

2. Description of Related Art

An image display device may display images that may be viewed by a user. The user may view a broadcast via the image display device. The image display device may display broadcast content selected by the user based on broadcast signals transmitted by broadcasting stations.

Also, a smart television (TV) may provide various content in addition to broadcast content. Instead of operating passively based on a user's selection, the smart TV may provide suggested content to the user without the user's selection of such content.

When a user views an image displayed by the image display device, the user may be affected by the surrounding illuminance environment. For example, when the illuminance environment around the image display device is a low-illuminance environment, glare may occur, and when it is a high-illuminance environment, the image quality of a displayed image may be reduced (that is, the screen brightness may be low). Accordingly, it may be difficult to provide an optimal image quality to the user.

SUMMARY

Provided are an image display device configured to provide an improved screen for viewing by a user based on an illuminance environment of an area external to the image display device and the characteristics of a frame displayed on the image display device and a method of operating the same.

Additional aspects are set forth in part in the description which follows and, in part, should be apparent from the description, or may be learned by practice of the presented embodiments of the disclosure.

According to an aspect of the disclosure, an image display device includes a backlight unit that may emit light towards a display panel, an illuminance sensor that may obtain illuminance information associated with an area that is external to the image display device, a memory that may store one or more instructions, and a processor that may execute the one or more instructions stored in the memory to identify a plurality of backlight control patterns that include different shapes, and that each represent a relationship between brightness information of a frame and a brightness of the backlight unit, select a backlight control pattern, from the plurality of backlight control patterns, based on the illuminance information, identify brightness information of a current frame, and adjust the brightness of the backlight unit based on the selected backlight control pattern and the brightness information of the current frame.

The processor may identify the plurality of backlight control patterns based on a screen mode of the image display device.

The processor may compare the illuminance information with a first threshold value, and select the backlight control pattern based on comparing the illuminance information with the first threshold value.

The processor may compare the illuminance information with the first threshold value and a second threshold value, and adjust the brightness of the backlight unit based on a first backlight control pattern corresponding to a low-illuminance environment based on the illuminance information being less than the first threshold value, adjust the brightness of the backlight unit based on a second backlight control pattern corresponding to a medium-illuminance environment based on the illuminance information being greater than or equal to the first threshold value and less than or equal to the second threshold value, or adjust the brightness of the backlight unit based on a third backlight control pattern corresponding to a high-illuminance environment based on the illuminance information being greater than the second threshold value.

Each of the plurality of backlight control patterns represents a duty cycle of a signal for controlling the backlight unit based on the brightness information of the frame, and the brightness of the backlight unit increases as a value of the duty cycle increases.

The plurality of backlight control patterns may include patterns in which the duty cycle of the signal represents a same value in a section where the brightness information of the frame is less than or equal to a threshold value.

The brightness information of the frame comprises average pixel level (APL) data representing an average brightness of pixels included in the frame.

The processor may adjust the brightness of the backlight unit based on a user input, store adjusted brightness information of the backlight unit based on a user input, and adjust the plurality of backlight control patterns based on the stored adjusted brightness information of the backlight unit.

The processor may adjust the plurality of backlight control patterns by using at least one neural network.

The processor may adjust the plurality of backlight control patterns based on an amount of the stored adjusted brightness information of the backlight unit being greater than or equal to a threshold value.

According to an aspect of the disclosure, a method of operating an image display device may include obtaining illuminance information associated with an area that is external to the image display device, identifying a plurality of backlight control patterns that include different shapes, and that each represent a relationship between brightness information of a frame and a brightness of a backlight unit, selecting a backlight control pattern, from the plurality of backlight control patterns, based on the illuminance information, identifying brightness information of a current frame, and adjusting a brightness of the backlight unit based on the selected backlight control pattern and the brightness information of the current frame.

According to another embodiment of the disclosure, a computer program product includes at least one non-transitory computer-readable medium storing a program for obtaining illuminance information associated with an area that is external to the image display device, identifying a plurality of backlight control patterns that include different shapes, and that each represent a relationship between brightness information of a frame and a brightness of a backlight unit, selecting a backlight control pattern, from the plurality of backlight control patterns, based on the illuminance information, identifying brightness information of a current frame, and adjusting a brightness of the backlight unit based on the selected backlight control pattern and the brightness information of the current frame.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
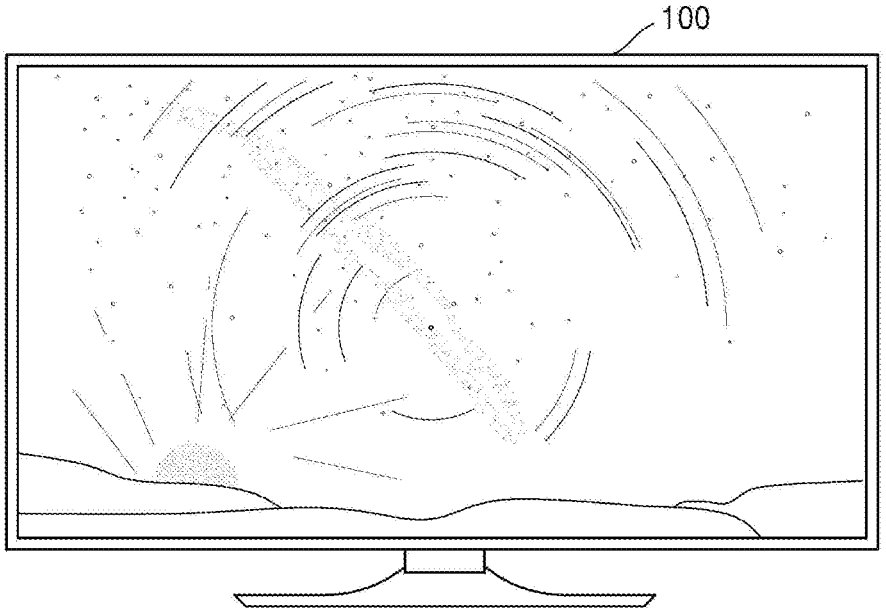
FIG. 1 is a diagram illustrating an image display device according to an embodiment.

The terms used herein will be briefly described, and embodiments of the disclosure will be described in detail.

The terms used herein may be terms known in the art in consideration of the disclosure, but the meanings of the terms may vary according to the intentions of those of ordinary skill in the art, precedents, or new technology in the art. Also, in some cases, there may be terms that are optionally selected by the applicant, and the meanings thereof will be described in detail in the corresponding portions of the description of the disclosure. Thus, the terms used herein should be understood based on the meanings of the terms and the overall description of the disclosure.

Throughout the specification, when something is referred to as "including" a component, another component may be further included unless specified otherwise. Also, the terms such as "units" and "modules" used herein may refer to units that perform at least one function or operation, and the units may be implemented as hardware, software, or a combination of hardware and software.

Hereinafter, embodiments will be described in detail with reference to the accompanying drawings so that those of ordinary skill in the art may implement the embodiments of the disclosure. However, the disclosure may be embodied in various different forms and should not be construed as being limited to the embodiments described herein. Also, like reference numerals may denote like elements throughout the specification.

Throughout the disclosure, the expression "at least one of a, b, or c" may indicate only a, only b, only c, both a and b, both a and c, both b and c, all of a, b, and c, or variations thereof.

FIG. 1 is a diagram illustrating an image display device according to an embodiment.

An image display device 100 according to an embodiment may be a television (TV). Alternatively, the image display device 100 may be implemented in various forms including a display. For example, the image display device 100 may be implemented as various electronic devices such as portable phones, tablet personal computers (PCs), digital cameras, camcorders, notebook computers (laptop computers), desktops, e-book terminals, digital broadcast terminals, personal digital assistants (PDAs), portable multimedia players (PMPs), navigation devices, MP3 players, and wearable devices. Also, the image display device 100 may be a fixed type or a mobile type, and may be a digital broadcasting receiver configured to receive digital broadcasting. Also, the image display device 100 may be implemented as a flat display device, a curved display device having a screen with curvature, or a flexible display device having an adjustable curvature. The output resolution of the image display device 100 may include, for example, High Definition (HD), Full HD, Ultra HD, or resolution greater than Ultra HD.

The image display device 100 may perform a backlight dimming function for adjusting the brightness (luminance) of a backlight unit. The backlight dimming may include global dimming for collectively controlling the overall brightness of the entire backlight unit, and local dimming for dividing the backlight unit into multiple light-emitting blocks and controlling the brightness on per block basis. Particularly, the global dimming may improve dynamic contrast and reduce power consumption. Also, the local dimming may be applied to a light emitting diode (LED) backlight unit using LEDs as a light source, and the global dimming may be applied to various types of backlight units.

The image display device 100 may analyze an input image, acquire the brightness information of a frame or content included in the frame, and control the brightness of the backlight unit based on the acquired brightness information of the frame or the content.

In this case, the image display device 100 may store, in advance, a backlight control pattern representing the brightness of the backlight unit based on the brightness information of a frame, and adjust the brightness of the backlight unit based on the stored backlight control pattern.

The surrounding illuminance environment of the image display device 100 may affect the user's ability to view the image display device 100. For example, glare may occur in a low-illuminance environment where the surrounding illuminance is low, and the image quality and definition may be reduced in a high-illuminance environment where the surrounding illuminance is high. Thus, in order to provide an improved image to the user, the backlight control pattern for adjusting the brightness of the backlight unit of the image display device 100 may be changed based on the surrounding illuminance environment.

Accordingly, the image display device 100 according to an embodiment may acquire the surrounding illuminance information, and adjust the brightness of the backlight unit based on the acquired surrounding illuminance information by using backlight control patterns having different patterns, which will be described below in more detail with reference to the drawings.

As used herein, the term "user" may refer to a viewer viewing the content displayed via the image display device, a person controlling the functions or operations of the image display device, a manager, an installation engineer, or the like.

As used herein, the terms "brightness" and "luminance" may be used interchangeably, and the term "luminance" may be used as a measure of brightness.

Figure 2:
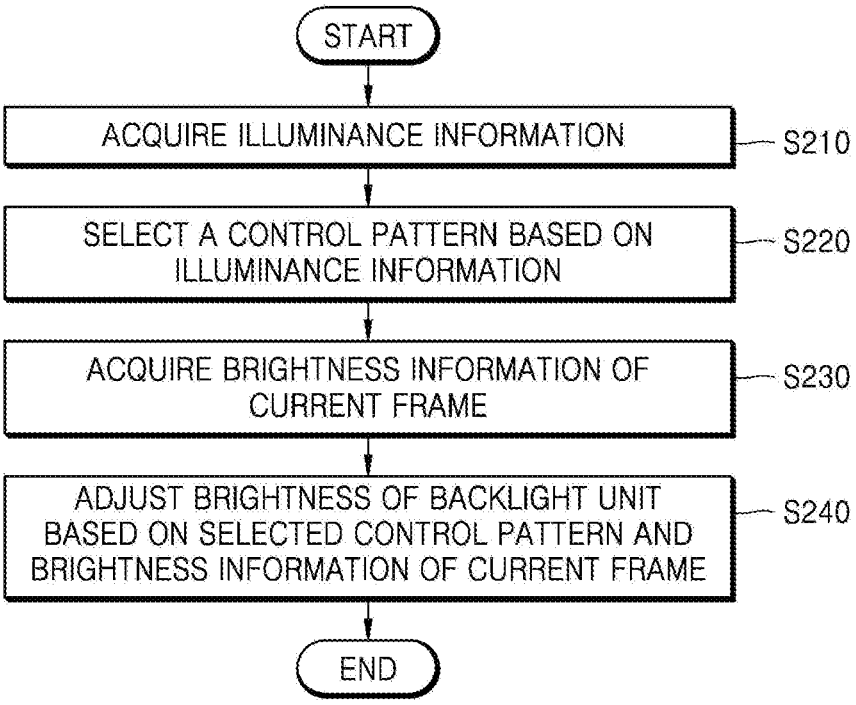
FIG. 2 is a flowchart illustrating a method of operating an image display device, according to an embodiment.

FIG. 2 is a flowchart illustrating a method of operating an image display device according to an embodiment.

Referring to FIG. 2, the image display device 100 according to an embodiment may acquire illuminance information (operation S210). The illuminance information may be associated with an area around the image display device 100, an area surrounding the image display device 100, an area within a threshold distance of the image display device 100, and/or the like. In other words, the illuminance information is associated with an external area disposed around or near the image display device 100.

The image display device 100 a may include an illuminance sensor, and may acquire the illuminance information associated with the area around the image display device 100 by using the illuminance sensor. For example, the illuminance information may include illuminance (e.g., intensity of illumination) having a unit of lux, and the illuminance may have a greater value as the brightness increases.

Also, the image display device 100 may acquire illuminance information associated with the area around the image display device 100 at preset periods.

The image display device 100 may select a backlight control pattern based on the acquired illuminance information (operation S220).

Multiple backlight control patterns may be stored in the image display device 100. A backlight control pattern may be a graph representing the brightness information of the backlight unit based on the brightness information of a frame. For example, the backlight control pattern may be a graph in which the x-axis represents the brightness information of a frame, and the y-axis represents the brightness information of the backlight unit. In this case, the brightness information of the backlight unit may include a duty cycle of a signal for controlling the backlight unit, and the brightness of the backlight unit may increase as the duty cycle value of the signal increases.

Also, the backlight control patterns may include patterns having different shapes. For example, the backlight control patterns may be graphs having different slopes in the same partial section.

Also, the backlight control patterns may be determined based on the screen mode of the image display device 100. For example, when the screen mode of the image display device 100 is a first screen mode (e.g., a "standard mode"), a first subset of backlight control patterns may be identified as the backlight control patterns, and when the screen mode of the image display device 100 is a second screen mode (e.g., a "movie mode"), a second subset of backlight control patterns may be identified as the backlight control patterns. Also, the first subset and the second subset of the backlight control patterns may include patterns having different shapes. However, the disclosure is not limited thereto.

The method of selecting a backlight control pattern based on the illuminance information acquired by the image display device 100 will be described in more detail with reference to FIG. 3.

The image display device 100 may acquire the brightness information of a current frame (operation S230).

The brightness information of a frame may include average pixel level (APL) data representing the average brightness of pixels included in the frame. The APL data may be a value calculated based on a luminance signal (Y) of each of the pixels included in the frame.

The image display device 100 may analyze input image data, and identify the APL data of the current frame.

The image display device 100 may adjust the brightness of the backlight unit based on the backlight control pattern selected in operation S220 and the brightness information of the current frame acquired in operation S230 (operation S240).

For example, in the selected backlight control pattern, the image display device 100 may adjust the brightness of the backlight unit by applying a signal having a duty cycle corresponding to the APL data of the current frame to the backlight unit.

Also, when the frame is changed and the brightness information of the frame (e.g., APL data) is changed, the image display device 100 may decrease or increase the brightness of the backlight unit by changing the duty cycle of the signal applied to the backlight unit to a duty cycle corresponding to the changed APL data.

Figure 3:
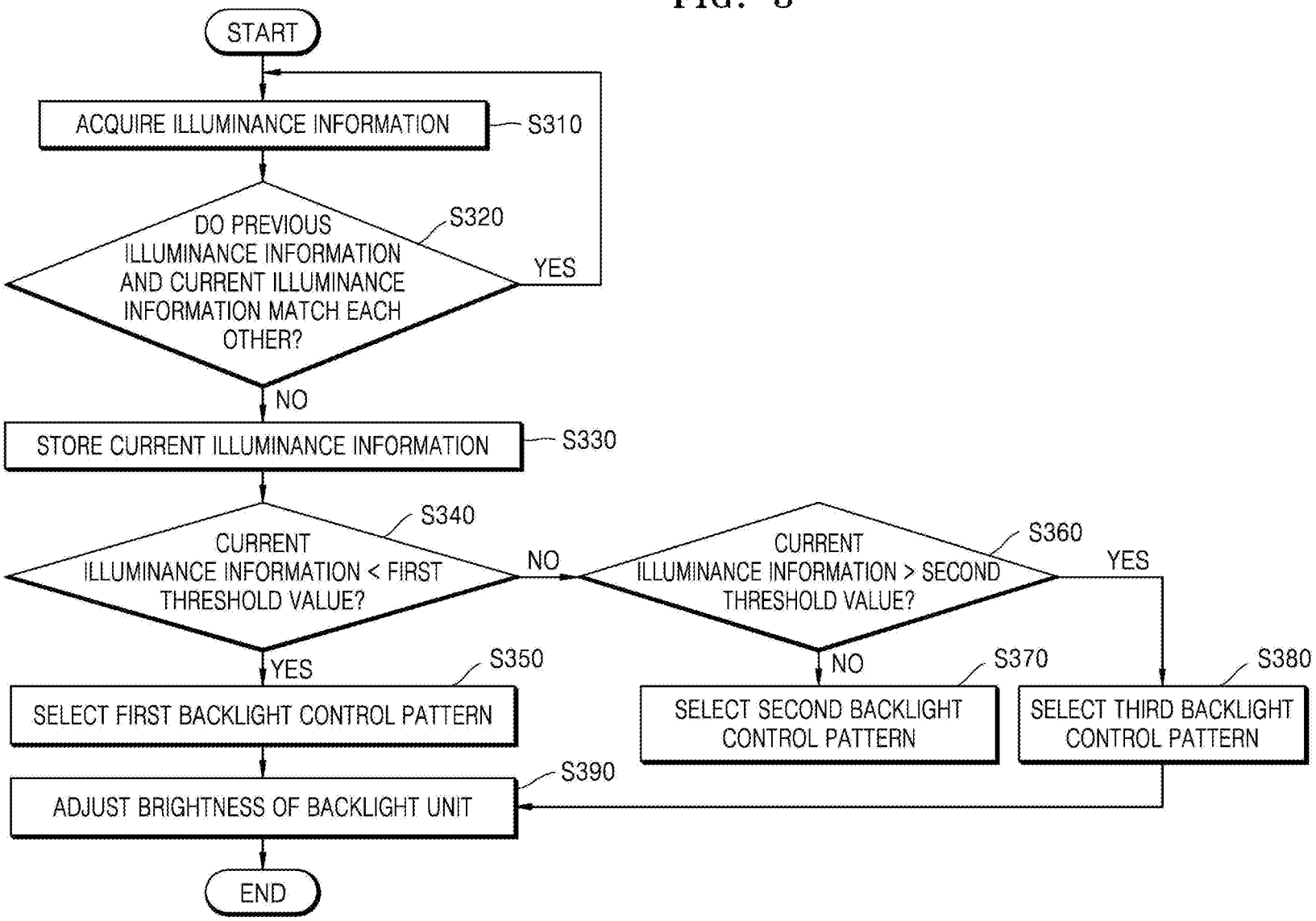
FIG. 3 is a diagram illustrating a method of selecting a backlight control pattern based on illuminance information acquired by an image display device, according to an embodiment.
Figure 4A:
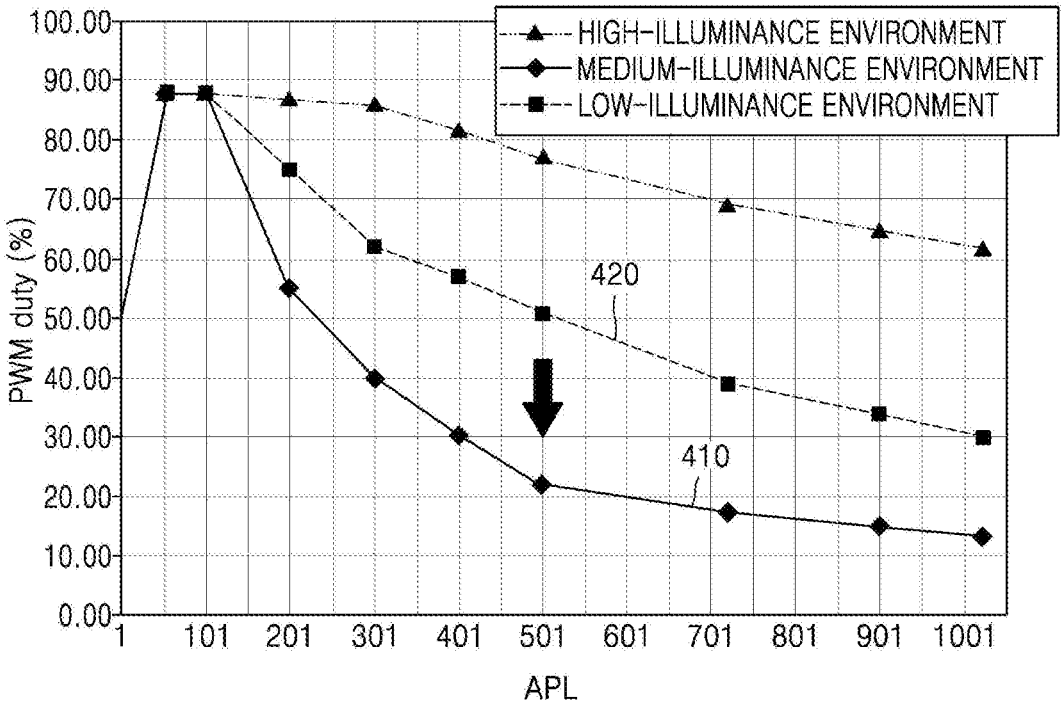
FIGS. 4A and 4B are diagrams of backlight control patterns according to an embodiment.
Figure 4B:
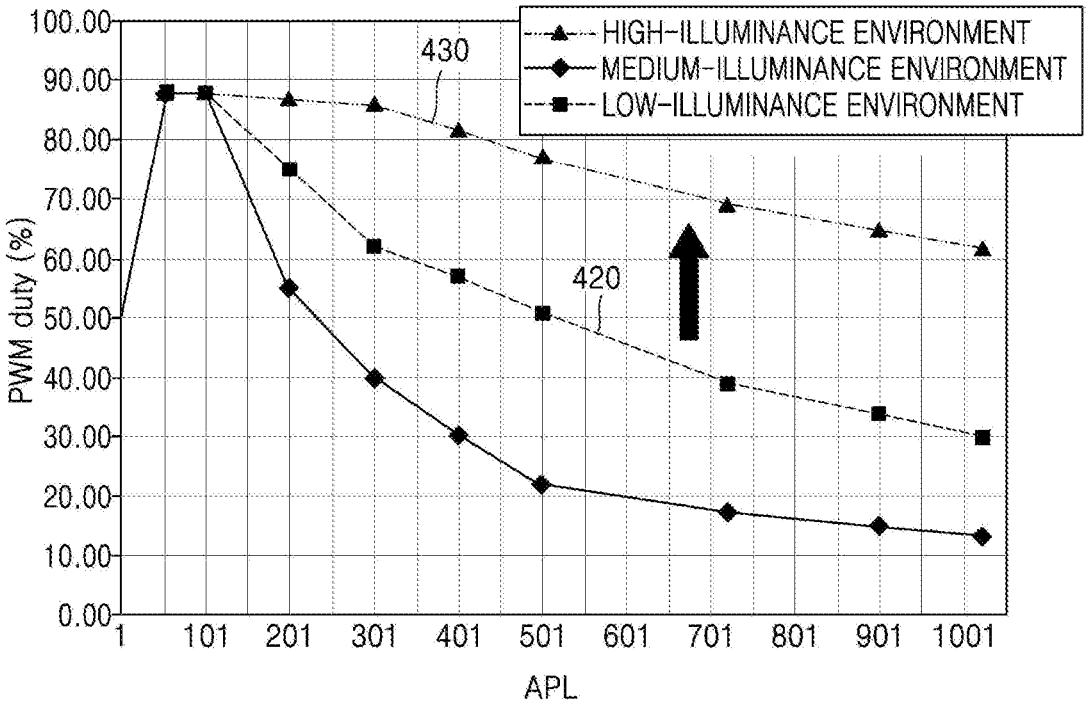

FIG. 3 is a diagram illustrating a method of selecting a backlight control pattern based on illuminance information acquired by an image display device according to an embodiment, and FIGS. 4A and 4B are diagrams referred to in description of FIG. 3.

Referring to FIG. 3, the image display device 100 may acquire illuminance information (operation S310). Operation S310 of FIG. 3 may be substantially the same as operation S210 of FIG. 2, and therefore a redundant description is omitted.

The image display device 100 may determine whether the previous illuminance information and the current illuminance information match each other (operation S320). For example, the image display device 100 may compare an illuminance value previously acquired by the illuminance sensor and an illuminance value currently acquired by the illuminance sensor, and determine whether the illuminance information matches. In this case, the illuminance information may match based on a difference between the previous illuminance value and the current illuminance value being less than a threshold value.

If the previous illuminance information and the current illuminance information match each other (operation S320—YES), then the image display device 100 may periodically acquire the illuminance information (e.g., may iteratively return to operation S310).

Alternatively, if the previous illuminance information and the current illuminance information do not match each other (operation S320—NO), then the image display device 100 may store the current illuminance information (operation S330). For example, the image display device 100 may store the current illuminance information instead of the previous illuminance information.

The image display device 100 may compare the current illuminance information with at least one of a first threshold value or a second threshold value greater than the first threshold value. For example, the image display device 100 may determine whether the current illuminance information is less than the first threshold value (operation S340).

If the current illuminance information is less than the first threshold value (operation S340—YES), then the image display device 100 may select a first backlight control pattern from the multiple backlight control patterns (operation S350). In this case, the first backlight control pattern may be a backlight control pattern corresponding to a low-illuminance environment.

Alternatively, if the current illuminance information is greater than or equal to the first threshold value (operation S340—NO), then the image display device 100 may determine whether the current illuminance information is greater than the second threshold value (operation S360).

If the current illuminance information is less than or equal to the second threshold value (operation S360—NO), then the image display device 100 may select a second backlight control pattern from the multiple backlight control patterns (operation S370). In this case, the second backlight control pattern may be a backlight control pattern corresponding to a medium-illuminance environment.

If the current illuminance information is greater than the second threshold value (operation S360—YES), then the image display device 100 may select a third backlight control pattern from the multiple backlight control patterns (operation S380). In this case, the third backlight control pattern may be a backlight control pattern corresponding to a high-illuminance environment.

The image display device 100 may adjust the brightness of the backlight unit by using the selected backlight control pattern (operation S390).

For example, and referring to FIGS. 4A and 4B, the backlight control patterns may include a first backlight control pattern 410, a second backlight control pattern 420, and a third backlight control pattern 430. In this case, the first backlight control pattern 410 may be a backlight control pattern corresponding to a low-illuminance environment, the second backlight control pattern 420 may be a backlight control pattern corresponding to a medium-illuminance environment, and the third backlight control pattern 430 may be a backlight control pattern corresponding to a high-illuminance environment.

Also, each of the backlight control patterns 410, 420, and 430 may be a graph representing the relationship between the APL data and the duty cycle of a signal (e.g., a pulse width modulation (PWM) signal) for controlling the backlight unit.

Also, the backlight control patterns 410, 420, and 430 may appear as different patterns. For example, the backlight control patterns 410, 420, and 430 may have different slopes in a partial section (e.g., a section where the value of the APL data is greater than or equal to "101" and less than or equal to "1001").

Also, the backlight control patterns 410, 420, and 430 may be backlight control patterns corresponding to a particular screen mode (e.g., the standard mode) from among multiple screen modes.

If the current illuminance environment is the medium-illuminance environment (e.g., when the current illuminance information is greater than or equal to the first threshold value and less than the second threshold value), then the image display device 100 may adjust the brightness of the backlight unit by using the second backlight control pattern 420. The image display device 100 may identify the APL data of the current frame, and adjust the brightness of the backlight unit by applying a PWM driving signal having a duty cycle corresponding to the identified APL data to the backlight unit. For example, if the APL data is 501, then the image display device 100 may apply a PWM driving signal having a duty cycle of 50% to the backlight unit.

If the illuminance environment changes from the medium-illuminance environment to the low-illuminance environment (e.g., when the current illuminance information is less than the first threshold value), then the image display device 100 may adjust the brightness of the backlight unit by using the first backlight control pattern 410, as illustrated in FIG. 4A. For example, when the APL data of the current frame is 501, the image display device 100 may apply a PWM driving signal having a duty cycle of 22% to the backlight unit. The image display device 100 may apply a driving signal having a lower duty cycle to the backlight unit in the low-illuminance environment than as compared to the medium-illuminance environment even when the APL data (brightness information) of the current frame is equal. Accordingly, the brightness of the backlight unit may decrease in the low-illuminance environment than as compared to the medium-illuminance environment.

Also, when the illuminance environment changes from the medium-illuminance environment to the high-illuminance environment (e.g., when the current illuminance information is greater than the second threshold value), the image display device 100 may adjust the brightness of the backlight unit by using the third backlight control pattern 430, as illustrated in FIG. 4B. For example, when the APL data of the current frame is 501, the image display device 100 may apply a PWM driving signal having a duty cycle of 77% to the backlight unit. The image display device 100 may apply a driving signal having a higher duty cycle to the backlight unit in the high-illuminance environment than as compared to the medium-illuminance environment even when the APL data (brightness information) of the current frame is equal. Accordingly, the brightness of the backlight unit may increase in the high-illuminance environment than as compared to the medium-illuminance environment.

Figure 5:
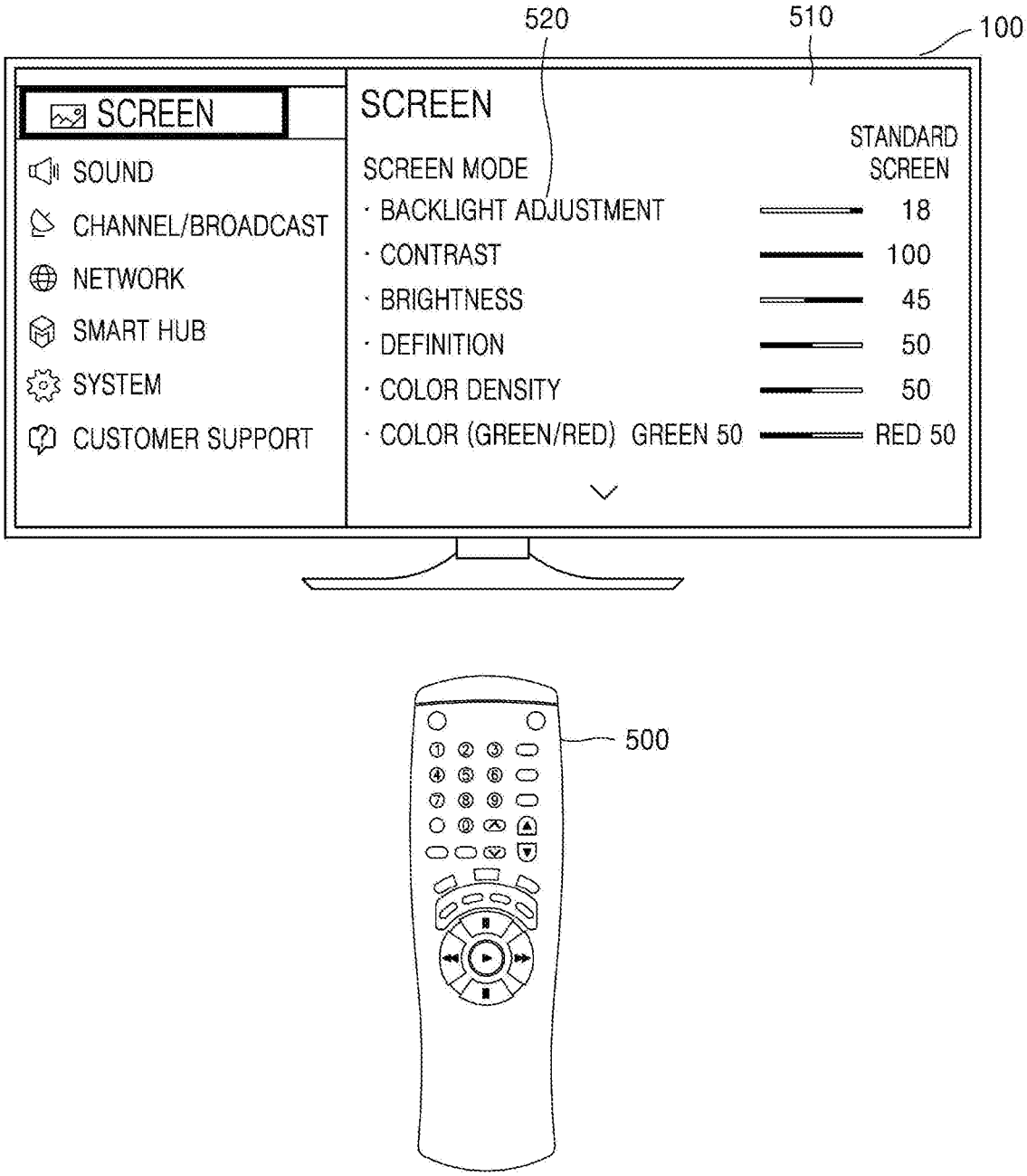
FIG. 5 is a diagram illustrating an example of adjusting the brightness of a backlight unit based on a user input, by an image display device, according to an embodiment.

FIG. 5 is a diagram illustrating an example of adjusting the brightness of a backlight unit based on a user input by an image display device according to an embodiment.

Referring to FIG. 5, the image display device 100 a may provide a function of adjusting the brightness of the backlight unit. For example, as illustrated in FIG. 5, based on a user input, the image display device 100 may display a screen setting menu 510 for setting parameters related to the screen. The screen setting menu 510 may include an item for setting a screen mode, an item for adjusting the backlight brightness, and items for adjusting the screen's contrast, brightness, definition, color density, and color. It should be understood that the screen setting menu of FIG. 5 is merely an example, and that other configurations are possible.

The user may select a backlight adjustment item 520 (i.e., an item for adjusting the brightness of the backlight unit) from the screen setting menu by using a control device 500, and may manually adjust the brightness of the backlight unit by using the selected item. In this case, the control device 500 may transmit data, or the like, to the image display device 100 by communicating (e.g., via short-range communication) with the image display device 100. For example, the image display device 100 may receive a control signal corresponding to a user input (e.g., a key or button input of the control device 500) from the control device 500, select the backlight adjustment item 520, and decrease or increase a value set for the item, to adjust the brightness of the backlight unit.

The image display device 100 may store the brightness information of the backlight unit adjusted by the user. Also, the image display device 100 may store the illuminance information, screen mode information, and frame brightness information (e.g., APL data) in a state where the brightness of the backlight unit is adjusted, corresponding to the adjusted brightness information of the backlight unit.

For example, in a state where the surrounding illuminance is 100 lux, the screen mode is the "standard mode", the APL data value of the current frame is "901", and the brightness value of the backlight unit is changed by a user input to a value corresponding to a duty cycle "20%", the image display device 100 may store the surrounding illuminance information ("100 Lux"), the screen mode information ("standard mode"), the APL data ("901"), and the adjusted brightness information of the backlight unit (e.g., a duty cycle "20%") to correspond to each other.

Figure 6:
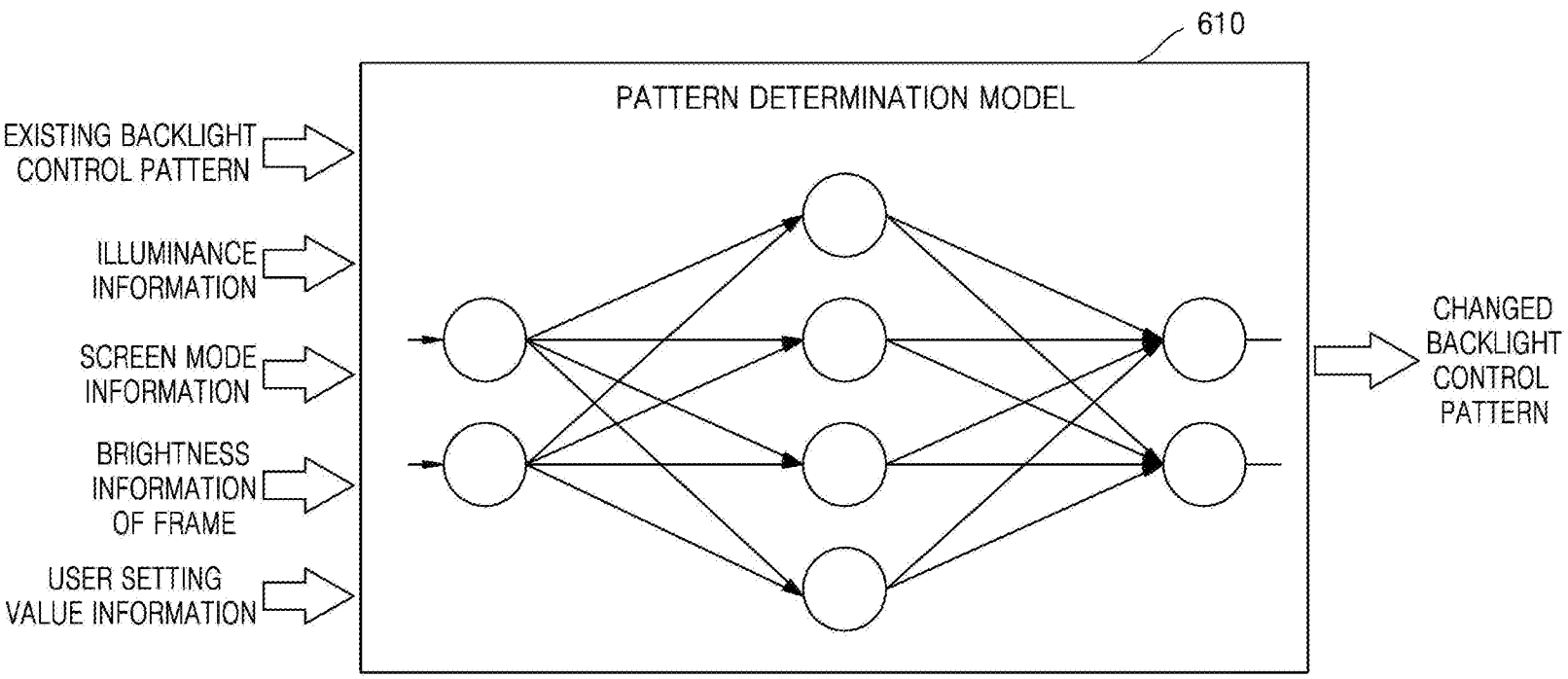
FIGS. 6 through 8 are diagrams of a method of changing a backlight control pattern based on the brightness information of a backlight unit adjusted by a user, by an image display device, according to an embodiment.
Figure 7:
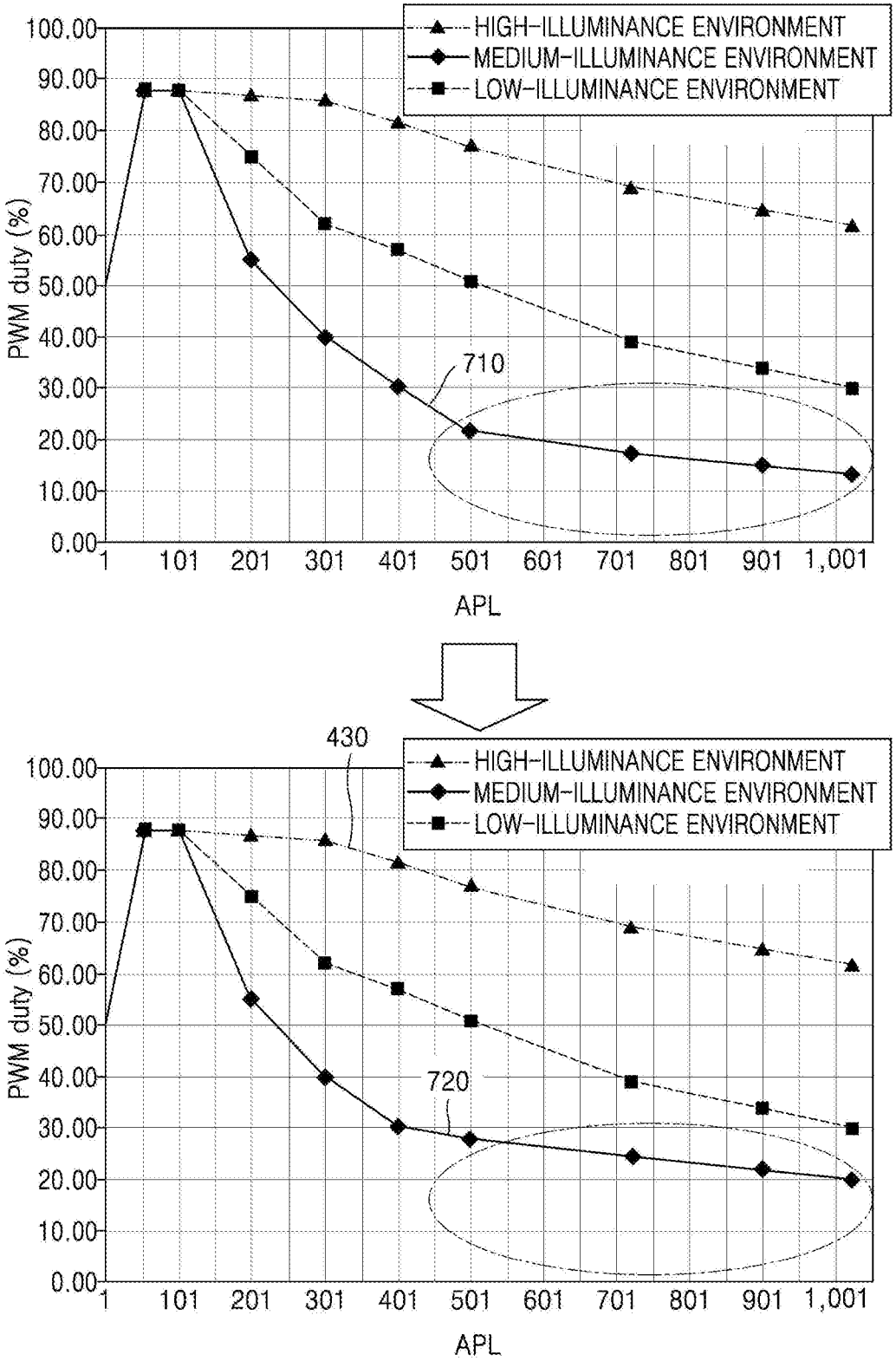
Figure 8:
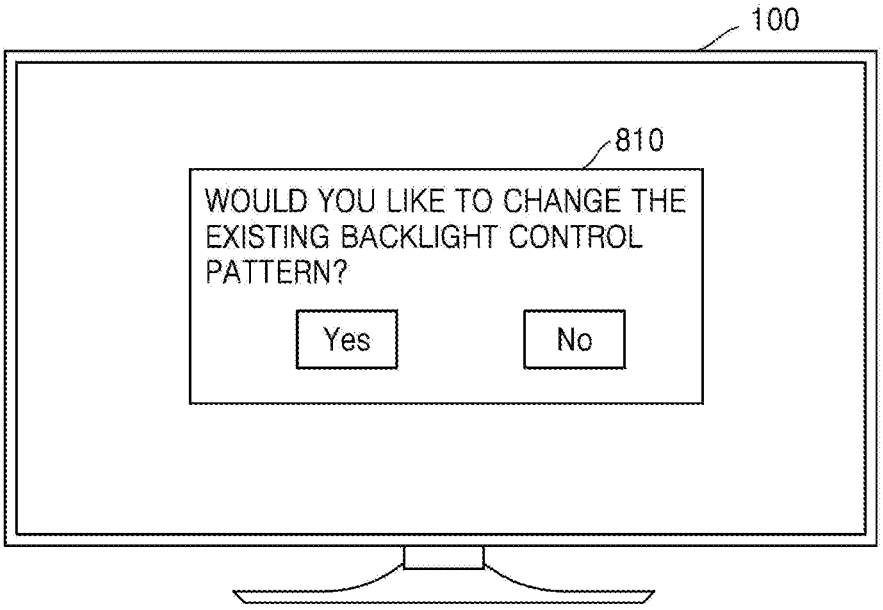

FIGS. 6 through 8 are diagrams of a method of changing a backlight control pattern based on the brightness information of a backlight unit adjusted by a user, by an image display device according to an embodiment.

The image display device 100 may train and update (or train and refine) a model of the backlight control pattern corresponding to the user by using the brightness information of the backlight unit adjusted by the user and stored in the image display device. When the amount of stored brightness information data of the backlight unit adjusted by the user is greater than a threshold value, the image display device 100 may change the backlight control pattern by using the collected (stored) information data.

For example, when an amount of data sets including the surrounding illuminance information, the screen mode information, the APL data, and the adjusted brightness information of the backlight unit is greater than a preset number, the image display device 100 may change the backlight control pattern by using data sets.

When the image display device 100 is in a standby mode state, the image display device 100 may change the backlight control pattern by using data sets. The standby mode state may refer to a state in which the image display device 100 is turned off (a state in which the display is turned off) while power is supplied from an external power source.

Also, the image display device 100 may change the backlight control pattern by using a pattern determination model including a set of neural networks. The pattern determination model may be stored in the memory of the image display device 100.

For example, the image display device 100 may input a data set including the surrounding illuminance information, the screen mode information, the APL data, and the adjusted brightness information of the backlight unit, as input data to the pattern determination model. Also, the existing backlight control pattern may be input as the input data to the pattern determination model.

The pattern determination model may change the existing backlight control pattern by processing the input data. In this case, in the existing backlight control pattern, the slope value of a partial section may be changed or the slopes of the entire section may be changed. Also, the changed backlight control pattern may be output in the form of a function.

Also, the pattern determination model may be stored in the memory of an external device. Accordingly, the image display device 100 may transmit collected (stored) data sets and the existing backlight control pattern to an external device, and the external device may change the existing backlight control pattern corresponding to the data sets by using the pattern determination model. The image display device 100 may receive the changed backlight control pattern from the external device, and may change (update) the existing backlight control pattern based on the received backlight control pattern.

FIG. 7 illustrates the existing backlight control pattern and the changed backlight control pattern. Referring to FIG. 7, a backlight control pattern 710 (the first backlight control pattern) corresponding to the low-illuminance environment may be changed based on the methods described in FIGS. 5 and 6. For example, when the user adjusts the brightness of the backlight unit a threshold number of times in the low-illuminance environment when the brightness of a frame is high, the image display device 100 may increase the duty cycle of a PWM signal in a section where the APL data value is about "401" to about "1001". Accordingly, the slopes may be changed in a section where the APL data value of the first backlight control pattern is about "401" to about "1001".

As shown in FIG. 8, the image display device 100 may display a message 810 for inquiring as to whether the user would like to replace the existing backlight control pattern with the changed backlight control pattern.

The user may select whether to change the existing backlight control pattern by using the control device 500, and based on a user input, the image display device 100 may maintain the existing backlight control pattern or change the existing backlight control pattern in accordance with the user input.

Figure 9:
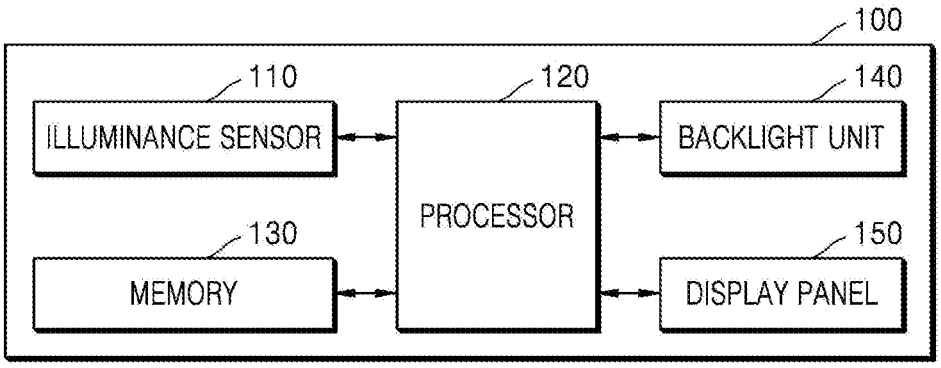
FIG. 9 is a block diagram illustrating a configuration of an image display device according to an embodiment.

FIG. 9 is a block diagram illustrating a configuration of an image display device according to an embodiment.

Referring to FIG. 9, an image display device 100 may include an illuminance sensor 110, a processor 120, a memory 130, a backlight unit 140, and a display panel 150.

The illuminance sensor 110 may acquire illuminance information associated with an external area around the image display device. For example, the illuminance sensor 110 may sense illuminance (intensity of illumination) having a unit of lux, and the illuminance may have a greater value as the brightness increases.

According to an embodiment of the disclosure, the processor 120 may execute one or more programs stored in the memory 130. The processor 120 may include a single core, a dual core, a triple core, a quad core, or any multiple thereof. Also, the processor 120 may include multiple processors. For example, the processor 120 may be implemented as a main processor (not illustrated) and a sub processor (not illustrated) operating in a sleep mode.

According to an embodiment, the memory 130 may store various data, programs, or applications for driving and controlling the image display device 100.

Also, the programs stored in the memory 130 may include one or more instructions. The application or program (one or more instructions) stored in the memory 130 may be executed by the processor 120.

The processor 120 may execute the one or more instructions stored in the memory 130, to select backlight control patterns having different shapes based on the acquired illuminance information. The backlight control patterns may be stored, in advance, in the memory 130. The backlight control patterns may be graphs representing the brightness information of the backlight unit according to the brightness information of a frame. For example, the plurality of backlight control patterns may be graphs in which the x-axis represents the brightness information of a frame, and the y-axis represents the brightness information of the backlight unit. In this case, the brightness information of the backlight unit may include a duty cycle of a signal for controlling the backlight unit, and the brightness of the backlight unit may increase as the duty cycle value of the signal increases.

The processor 120 may compare the illuminance information and at least one threshold value to select a backlight control pattern. For example, the processor 120 may compare the illuminance information with at least one threshold value to select a backlight control pattern corresponding to the low-illuminance environment when the current illuminance is the low-illuminance environment, select a backlight control pattern corresponding to the medium-illuminance environment when the current illuminance is the medium-illuminance environment, and select a backlight control pattern corresponding to the high-illuminance environment when the current illuminance is the high-illuminance environment.

Also, the processor 120 may identify the brightness information of the current frame. For example, the processor 120 may analyze the input image data, identify the APL data of the current frame, and identify the APL data as the brightness information of the current frame.

Also, the processor 120 may adjust the brightness of the backlight unit based on the selected backlight control pattern and the brightness information of the current frame. In the selected backlight control pattern, the processor 120 may control to apply a signal having a duty cycle corresponding to the APL data of the current frame to the backlight unit 140.

Also, the processor 120 may store the brightness information of the backlight unit 140 adjusted by the user in the memory 130, learn (or train) the backlight control pattern of the user, and update (or refine) the existing backlight control pattern, by using the stored brightness information of the backlight unit. In this case, the processor 120 may change the backlight control pattern by using the pattern determination model including at least one neural network.

The backlight unit 140 may be a light source device that supplies light to the display panel 150. The backlight unit 140 may be arranged on the rear surface of the display panel 150.

The display panel 150 may include a liquid crystal display (LCD). The display panel 150 may include two transparent substrates joined together with a certain distance therebetween and a liquid crystal layer interposed therebetween. Gate lines GL and data lines DL are vertically intersected on the lower substrate among the two transparent substrates, and pixel regions are defined in a matrix form according to the intersection structure.

Because the liquid crystal display panel itself may not emit light, the liquid crystal display panel may display an image by receiving light emitted from the backlight unit 140. Because the light emitted from the backlight unit 140 may pass through the liquid crystal display panel, the transmission and color thereof may be adjusted and an image displayed on the liquid crystal display panel may be viewed by the user. The backlight unit 140 may include a light source such as thin and slim cold cathode fluorescent lamps or LEDs on the upper/lower or left/right sides of the liquid crystal display panel, and may include a light guide plate such that the light emitted from the light source may spread uniformly on the liquid crystal display panel.

Figure 10:
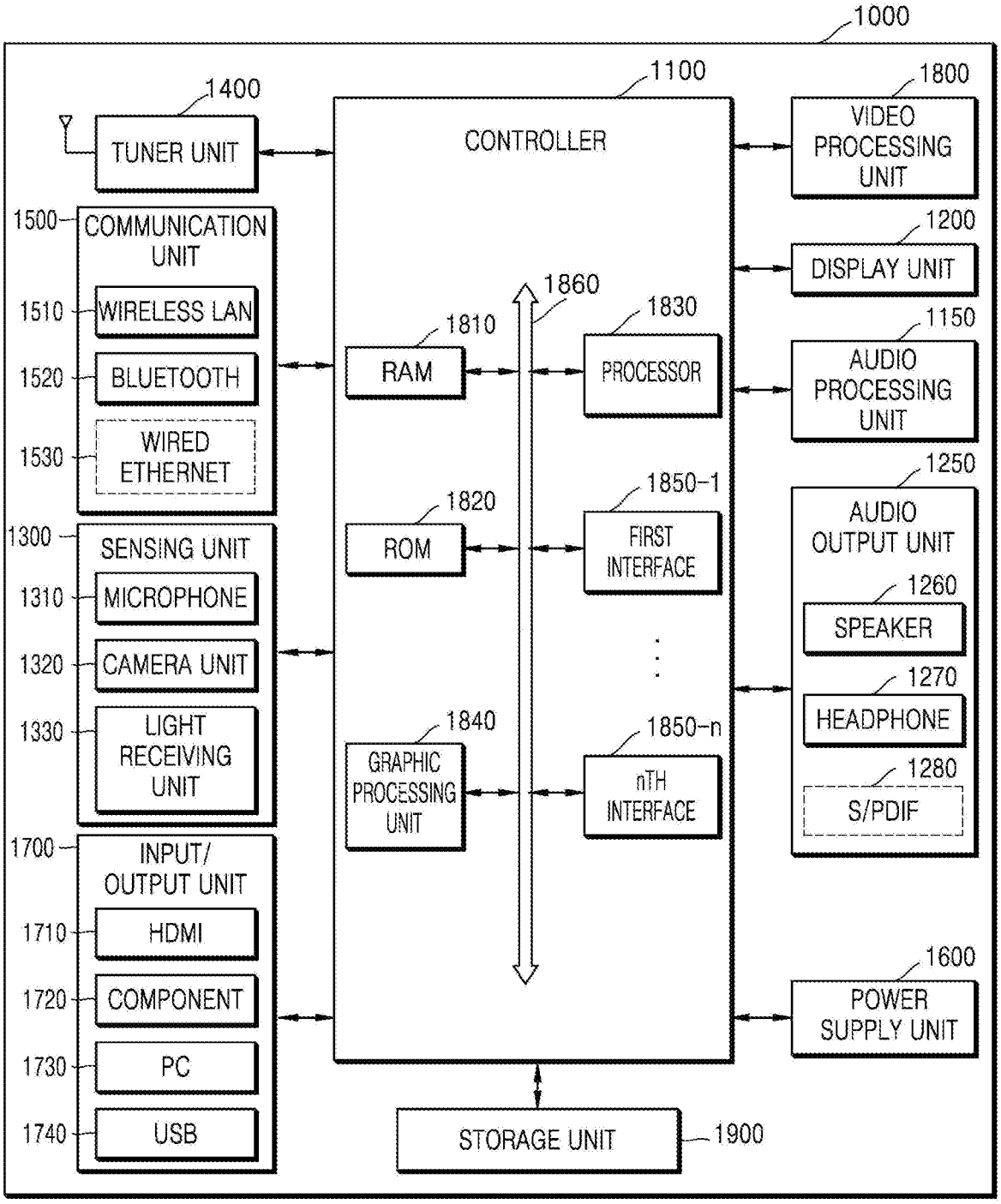
FIG. 10 is a block diagram illustrating a configuration of an image display device according to an embodiment.

FIG. 10 is a block diagram illustrating a configuration of an image display device according to an embodiment. An image display device 1000 of FIG. 10 may be an example of the image display device 100 of FIG. 1.

Referring to FIG. 10, the image display device 1000 may include a tuner unit 1400, a controller 1100, a display unit 1200, a communication unit 1500, a sensing unit 1300, an input/output unit 1700, a video processing unit 1800, an audio processing unit 1150, a storage unit 1900, and a power supply unit 1600.

The controller 1100 of FIG. 10 may correspond to the processor 120 of FIG. 9, and the storage unit 1900 of FIG. 10 may correspond to the memory 130 of FIG. 9. Accordingly, redundant descriptions is omitted.

The tuner unit 1400 (e.g., a tuner) may process a broadcast signal, which is received via a wired connection or wirelessly, via amplification, mixing, and/or resonance, and may tune and select a frequency of a channel, which is to be received by the image display device 1000. The broadcast signal may include audio, video, and additional information (e.g., electronic program guide (EPG)).

The tuner unit 1400 may receive a broadcast signal in a frequency band corresponding to a channel number according to a user input (e.g., control signals received from a control device, such as a channel number input, a channel up-down input, and a channel input via an EPG screen).

The tuner unit 1400 may receive broadcast signals from various sources such as terrestrial broadcasting, cable broadcasting, satellite broadcasting, and Internet broadcasting. The tuner unit 1400 may receive a broadcast signal from a source such as analog broadcasting or digital broadcasting.

The communication unit 1500 (e.g., a communication interface) may exchange data or signals with an external device or a server, based on a control of the controller 1100. The controller 1100 may transmit content to and receive content from external devices via the communication unit 1500, download an application from the external device, or perform Web browsing.

The communication unit 1500 may transceive data or signals using wireless LAN 1510 (e.g., wireless fidelity (Wi-Fi)), Bluetooth 1520, or wired Ethernet 1530 corresponding to the performance and structure of the image display device 1000.

The communication unit 1500 may perform communication with a control device by using short-range communication. For example, the communication unit 1500 may exchange data or signals with the control device by using a Bluetooth module, a Wi-Fi module, a near field communication (NFC) system, an infrared module, a Zigbee module, or the like.

The communication unit 1500 may receive a control command for controlling the operation of the image display device from the control device, and may perform operations based on the control command.

The video processing unit 1800 (e.g., video processor) may perform processing on video data received by the image display device 1000. The video processing unit 1800 may perform various image processing on the video data, such as decoding, scaling, noise filtering, frame rate conversion, and resolution conversion.

The sensing unit 1300 (e.g., sensor) may sense the user's voice, the user's image, or the user's interaction, and may include a microphone 1310, a camera unit 1320, and a light receiving unit 1330.

The microphone 1310 may receive an audio signal corresponding to a user's voice. The microphone 1310 may convert the received audio signal into an electrical signal and output the electrical signal to the controller 1100. The user's voice input may include, for example, a voice input corresponding to the function or menu of the image display device 1000.

The camera unit 1320 may receive an image (e.g., consecutive frames) corresponding to the user's motion including a gesture within a camera recognition range. Based on the received motion recognition result, the controller 1100 may select a menu displayed on the image display device 1000 or may perform a control corresponding to the motion recognition result.

The light receiving unit 1330 (e.g., light receiver) may receive an optical signal (including a control signal), which is received from an external control device, via an optical window (not illustrated) of a bezel of the display unit 1200. The light receiving unit 1330 may receive an optical signal corresponding to a user input (e.g., touch, press, touch gesture, voice, or motion) from the control device. The control signal may be extracted from the received optical signal based on a control of the controller 1100.

The input/output unit 1700 (e.g., an input interface and/or output interface) may receive, for example, video (e.g., moving image), audio (e.g., voice and music), and additional information (e.g., EPG (Electronic Program Guide)) from an external device based on the control of the controller 1100. The input/output unit 1700 may include an high-definition multimedia interface (HDMI) port 1710, a component jack 1720, a PC port 1730, and a universal serial bus (USB) port 1740. The input/output unit 1700 may include any combination of the HDMI port 1710, the component jack 1720, the PC port 1730, and the USB port 1740.

The controller 1100 may control an overall operation of the image display device 1000 and a signal flow between the internal components of the image display device 1000, and perform a data processing function. Based on a user's input or a preset condition being satisfied, the controller 1100 may execute various applications and an operating system (OS) stored in the storage unit 1900.

The controller 1100 may include a processor 1830, a read-only memory (ROM) 1820 that stores a control program for controlling the image display device 1000, and a random access memory (RAM) 1810 that stores a signal or data input from outside the image display device 1000 or is used as a storage region corresponding to various operations performed by the image display device 1000.

A graphic processing unit 1840 (e.g., a graphics processor) may generate a screen including various objects such as icons, images, and text by using an operation unit (not illustrated) and a rendering unit (not illustrated). The operation unit may calculate an attribute value such as a coordinate value, a shape, a size, and a color to be displayed for each of the objects according to the layout of the screen by using the user input sensed through the sensing unit 1300. The rendering unit may generate a screen of various layouts including objects based on the attribute value calculated by the operation unit. The screen generated by the rendering unit may be displayed in a display region of the display unit 1200.

First through nth interfaces 1850-1 to **1850-*n* may be connected to the above components. One of the first to nth interfaces 1850-1 to 1850-*n*** may be a network interface that is connected with an external device via a network.

The RAM 1810, the ROM 1820, the processor 1830, the graphic processing unit 1840, and the first through nth interfaces 1850-1 to **1850-*n* may be connected to each other via an internal bus 1860**.

As used herein, the term "controller of image display device" may include the processor 1830, the ROM 1820, and the RAM 1810.

The display unit 1200 may generate a driving signal by converting an image signal, a data signal, an on-screen display (OSD) signal, or a control signal processed by the controller 1100. The display unit 1200 may be implemented as a plasma display panel (PDP), an LCD, an OLED, or a flexible display, and may also be implemented as a three dimensional (3D) display. Also, the display unit 1200 may be configured as a touch screen to be used as an input device in addition to an output device.

The audio processing unit 1150 (e.g., audio processor) may perform processing on audio data. The audio processing unit 1150 may perform various processing functions such as decoding, amplification, and noise filtering of the audio data. Meanwhile, the audio processing unit 1150 may include a plurality of audio processing modules for processing the audio corresponding to content.

An audio output unit 1250 (e.g., audio output component) may output the audio included in the broadcast signal that is received through the tuner unit 1400 based on a control of the controller 1100. The audio output unit 1250 may output the audio (e.g., voice and sound) input through the input/output unit 1700 or the communication unit 1500. Also, the audio output unit 1250 may output the audio stored in the storage unit 1900 based on a control of the controller 1100. The audio output unit 1250 may include at least one of a speaker 1260, a headphone output port 1270, or a Sony/Philips digital interface (S/PDIF) output port 1280. The audio output unit 1250 may include a combination of the speaker 1260, the headphone output port 1270, and the S/PDIF output port 1280.

The power supply unit 1600 (e.g., power supply) may supply power from the external power source to the internal components of the image display device 1000 based on a control of the controller 1100. Also, the power supply unit 1600 may supply power, which is output from one or more batteries (not illustrated) located in the image display device 1000, to the internal components based on a control of the controller 1100.

The storage unit 1900 (e.g., storage) may store various data, programs, or applications for operating and controlling the image display device 1000 based on a control of the controller 1100. The storage unit 1900 may include a broadcast receiving module; a channel control module; a volume control module; a communication control module; a voice recognition module; a motion recognition module; a light receiving module; a display control module; an audio control module; an external input control module; a power control module; a power control module of an external device connected by wireless (e.g., Bluetooth); a voice database (DB); or a motion DB (not illustrated). The DB and modules (not illustrated) of the storage unit 1900 may be implemented as a software type to perform, in the image display device 1000, a broadcast receiving control function, a channel control function, a volume control function, a communication control function, a voice recognition function, a motion recognition function, a light receiving control function, a display control function, an audio control function, an external input control function, a power control function, or a power control function of the external device connected by wireless (e.g., Bluetooth). The controller 1100 may perform a function by using the software stored in the storage unit 1900.

Meanwhile, the block diagrams of the image display devices 100 and 1000 illustrated in FIGS. 9 and 10 are block diagrams for an embodiment. Each component of the block diagram may be integrated, added, or omitted according to the specification of the image display devices 100 and 1000 in practice. That is, two or more components may be integrated into a single component, and/or a single component may be divided into two or more components. Also, a function performed in each block is to describe embodiments of the disclosure, and a particular operation or device thereof is not intended to limit the scope of the disclosure.

The operation method of the image display device may be stored in a non-transitory computer-readable medium by being implemented in the form of program commands that may be performed by various computer components. The computer-readable medium may include program commands, data files, and data structures. The program commands recorded on the computer-readable medium may be those that are specifically designed and configured to perform functions of the disclosure. Examples of the computer-readable medium may include magnetic recording mediums such as hard disks, floppy disks, and magnetic tapes, optical recording mediums such as compact disk read-only memories (CD-ROMs) and digital versatile disks (DVDs), magneto-optical recording mediums such as floptical disks, and hardware devices such as ROMs, RAMs, and flash memories that are configured to store and execute program commands. Examples of the program commands may include machine language code that may be generated by a compiler, and high-level language code that may be executed by a computer by using an interpreter.

Also, the operation method of the image display device according to the described embodiments of the disclosure may be included and provided in a computer program product. The computer program product may be traded as a product between a seller and a buyer.

The computer program product may include a software (S/W) program and a computer-readable storage medium with an S/W program stored therein. For example, the computer program product may include products in the form of S/W programs (e.g., downloadable apps) distributed electronically through manufacturers of image display devices or electronic markets (e.g., Google Play Store and App Store). For electronic distribution, at least a portion of the S/W program may be stored in a storage medium or may be generated temporarily. In this case, the storage medium may be a storage medium of a server of a manufacturer, a server of an electronic market, or a relay server for temporarily storing an S/W program.

In a system including a server and a client device, the computer program product may include a storage medium of the server or a storage medium of the client device. Alternatively, when there is a third device (e.g., a smartphone) communicatively connected to the server or the client device, the computer program product may include a storage medium of the third device. Alternatively, the computer program product may include the S/W program itself that is transmitted from the server to the client device or the third device or transmitted from the third device to the client device.

In this case, one of the server, the client device, and the third device may execute the computer program product to perform the method according to the described embodiments of the disclosure. Alternatively, two or more of the server, the client device, and the third device may execute the computer program product to perform the method according to the described embodiments of the disclosure in a distributed manner.

For example, the server (e.g., a cloud server or an artificial intelligence (AI) server) may execute the computer program product stored in the server, to control the client device communicatively connected to the server to perform the method according to the described embodiments of the disclosure.

The image display device according to an embodiment may provide an improved screen to the user by adjusting the brightness of the backlight unit adaptively based on the surrounding illuminance environment and the brightness information of the frame.

The image display device according to an embodiment may reduce the occurrence of glare in a low-illuminance environment, and may maintain the screen brightness in a high-illuminance environment.

Although the embodiments have been described above in detail, the scope of the disclosure is not limited thereto and those of ordinary skill in the art should understand that various modifications and improvements may be made therein without departing from the spirit and scope of the disclosure as defined by the following claims.

What is claimed is:

1. An image display device comprising:

a backlight unit configured to emit light towards a display panel;

an illuminance sensor configured to obtain illuminance information associated with an arm that is external to the image display device;

a memory configured to store one or more instructions; and a processor configured to execute the one or more instructions stored in the memory to:

select a backlight control pattern, from a plurality of backlight control patterns stored in the memory, corresponding to the obtained illuminance information;

identify average pixel level (APL) data of a current frame;

identify, using the selected backlight control pattern, a duty cycle corresponding to the identified APL data of the current frame; and change a brightness of the backlight unit by applying a pulse width modulation (PWM) signal having the identified duty cycle, wherein each backlight control pattern of the plurality of backlight control patterns is a graph having a first axis representing APL data of a frame, and a second axis representing a duty cycle of a PWM signal for controlling the backlight unit, wherein the plurality of backlight control patterns include same slopes in a first section where a value of the APL data of the frame is less than a first value, and wherein the plurality of backlight control patterns include different slopes in a second section where the value of the APL data of the frame is greater than or equal to the first value and less than or equal to a second value.

2. The image display device of claim 1, wherein the processor is further configured to execute the one or mom instructions to:

identify the plurality of backlight control patterns based on a screen mode of the image display device.

3. The image display device of claim 1, wherein the processor is further configured to execute the one or more instructions to:

compare the illuminance information with a first threshold value; and select the backlight control pattern based on comparing the illuminance information with the first threshold value.

4. The image display device of claim 3, wherein the processor is further configured to execute the one or more instructions to:

compare the illuminance information with the first threshold value and a second threshold value; and change the brightness of the backlight unit based on a first backlight control pattern corresponding to a low-illuminance environment based on the illuminance information being less than the first threshold value;

change the brightness of the backlight unit based on a second backlight control pattern corresponding to a medium-illuminance environment based on the illuminance information being greater than or equal to the first threshold value and less than or equal to the second threshold value; or change the brightness of the backlight unit based on a third backlight control pattern corresponding to a high-illuminance environment based on the illuminance information being greater than the second threshold value.

5. The image display device of claim 1, wherein the brightness of the backlight unit increases as a value of the duty cycle increases.

6. The image display device of claim 1, wherein the processor is further configured to execute the one or more instructions to:

change the brightness of the backlight unit based on a user input;

store adjusted brightness information of the backlight unit based on a user input; and adjust the plurality of backlight control patterns based on the stored adjusted brightness information of the backlight unit.

7. The image display device of claim 6, wherein the processor is further configured to execute the one or more instructions to:

change the plurality of backlight control patterns by using at least one neural network.

8. The image display device of claim 6, wherein the processor is further configured to execute the one or more instructions to:

change the plurality of backlight control patterns based on an amount of the stored adjusted brightness information of the backlight unit being greater than or equal to a threshold value.

9. A method of operating an image display device, the method comprising:

obtaining illuminance information associated with an area that is external to the image display device;

selecting a backlight control pattern, from a plurality of backlight control patterns stored in the image display device, corresponding to the obtained illuminance information;

identifying average pixel level (APL) data of a current frame;

identifying, using the selected backlight control pattern, a duty cycle corresponding to the identified APL data of the current frame; and changing a brightness of a backlight unit by applying a pulse width modulation (PWM) signal having the identified duty cycle, wherein each backlight control pattern of the plurality of backlight control patterns is a graph having a first axis representing APL data of a frame, and a second axis representing a duty cycle of a PWM signal for controlling the backlight unit, wherein the plurality of backlight control patterns include same slopes in a first section where a value of the APL data of the frame is less than a first value, and wherein the plurality of backlight control patterns include different slopes in a second section where the value of the APL data of the frame is greater than or equal to the first value and less than or equal to a second value.

10. The method of claim 9, farther comprising:

identifying the plurality of backlight control patterns based on a screen mode of the image display device.

11. The method of claim 9, wherein the selecting the backlight control pattern comprises:

comparing the illuminance information with a first threshold value; and selecting the backlight control pattern based on comparing the illuminance information with the first threshold value.

12. The method of claim 11, further comprising:

comparing the illuminance information with the first threshold value and a second threshold value; and selecting a first backlight control pattern corresponding to a low-illuminance environment based on the illuminance information being smaller than the first threshold value;

selecting a second backlight control pattern corresponding to a medium-illuminance environment based on the illuminance information being greater than or equal to the first threshold value and less than or equal to the second threshold value; or selecting a third backlight control pattern corresponding to a high-illuminance environment based on the illuminance information being greater than the second threshold value.

13. The method of claim 9, wherein the brightness of the backlight unit increases as a value of the duty cycle increases.

14. The method of claim 9, further comprising:

receiving a user input for adjusting the brightness of the backlight unit;

changing the brightness of the backlight unit based on the user input;

storing adjusted brightness information of the backlight unit based on adjusting the brightness of the backlight unit; and adjusting the plurality of backlight control patterns based on the stored adjusted brightness information of the backlight unit.

15. The method of claim 14, wherein the changing of the plurality of backlight control patterns comprises adjusting the plurality of backlight control patterns by using at least one neural network.

16. The method of claim 14, wherein the changing of the plurality of backlight control patterns comprises adjusting the plurality of backlight control patterns based on an amount of the stored adjusted brightness information of the backlight unit being greater than or equal to a threshold value.

* * * * *